US006336345B1

(12) United States Patent
Corduan

(10) Patent No.: US 6,336,345 B1
(45) Date of Patent: Jan. 8, 2002

(54) PROCESS AND APPARATUS FOR LOW TEMPERATURE FRACTIONATION OF AIR

(75) Inventor: Horst Corduan, Puchheim (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/609,762

(22) Filed: Jul. 3, 2000

(30) Foreign Application Priority Data

Jul. 5, 1999 (DE) ..... 199 30 731

(51) Int. Cl.[7] ..... F25J 3/00
(52) U.S. Cl. ..... 62/646
(58) Field of Search ..... 62/643, 646

(56) References Cited

U.S. PATENT DOCUMENTS 4,372,764 A * 2/1983 Theobald ..... 62/646
5,275,003 A * 1/1994 Agrawal et al. ..... 62/646
5,454,226 A * 10/1995 Darredeau et al. ..... 62/646
5,901,576 A * 5/1999 Agrawal et al. ..... 62/646

* cited by examiner

*Primary Examiner*—William C. Doerrler
(74) *Attorney, Agent, or Firm*—Crowell & Moring LLP

(57) ABSTRACT

The method and the device are used for the cryogenic separation of air. Compressed and purified application air (9, 10, 20) is cooled in a main heat exchanger (30) and is at least partially fed (12, 33) to a rectifying column (50). A first partial flow (26) of the application air is fed to the main heat exchanger (30), is at least partially withdrawn at a first intermediate temperature from the main heat exchanger (28), and is fed to a cold compression (29). The first partial flow (26) is warmed up (27) upstream of its withdrawal (28) at the first intermediate temperature in the main heat exchanger (30).

20 Claims, 4 Drawing Sheets

PROCESS AND APPARATUS FOR LOW TEMPERATURE FRACTIONATION OF AIR

BACKGROUND AND SUMMARY OF THE INVENTION

The invention relates to a method for the cryogenic separation of air, in which compressed and purified application air is cooled in a main heat exchanger and is supplied at least in part to a rectifying column, a first partial flow of the application air being removed from the main heat exchanger at an intermediate temperature and being supplied to a cold compression at this intermediate temperature.

A method and a device for the cryogenic separation of air are known, for example, from "Tieftemperaturtechnik", 2nd Edition, 1985, Chapter 4 (Pages 281 to 337) by Hausen/Linde.

The invention is used in those cases in which a portion of the application air ("first partial flow") is aftercompressed, for example, in order to be used for the evaporation of a liquid process flow. The liquid process flow may be a product flow (such as liquid oxygen, liquid nitrogen or liquid argon) from a rectifying column; the sump liquid or intermediate liquid of a rectifying column; or an external liquid which is taken, for example, from a storage tank. It is also possible to evaporate two or more such process flows against the aftercompressed partial air flow.

The "main heat exchanger" is preferably formed by a single heat exchanger block. In the case of larger systems, it may be useful to implement the main heat exchanger by several pipe trains which are connected in parallel with respect to the temperature course and which are formed by mutually separate structural elements. In principle, it is also conceivable that the main heat exchanger or each of these pipe trains is formed by two or more serially connected blocks.

In many cases, this aftercompression is carried out in a conventional manner in that the partial air flow is supplied to a corresponding machine approximately at ambient temperature. As an alternative, a cold compressor can be used for the aftercompression. In this case, "cold compression" is a compressing operation in which the gas is fed to the compression at a temperature which is clearly below the ambient temperature, generally below 250 K, preferably below 200 K.

Methods are known from International Patent Document WO 9528610 or European Patent Document EP 644388A, in which the cold compression is carried out at an intermediate temperature which is between the temperatures at the warm and cold end of the main heat exchanger. This intermediate temperature may particularly be at the point at which the curves of the flows to be warmed up and to be cooled come closest to one another in the heat exchange diagram (Q-T diagram) of the main heat exchanger ("theoretical pinch point").

In the known methods, the partial air flow, which leads to the cold compression, is cooled in the main heat exchanger from the warm end to the intermediate temperature and, at the corresponding intermediate point of the main heat exchanger, is taken out directly from the cooling passages.

It is an object of the invention to provide the method of the initially mentioned type and a corresponding device which, with respect to energy, can be operated particularly advantageously.

This object is achieved in that the first partial flow is warmed up upstream of its removal in the main heat exchanger.

According to the invention, the partial air flow provided for the cold compression is therefore first cooled more than actually necessary in the main heat exchanger, thus beyond the intermediate temperature which corresponds approximately to the inlet temperature of the cold compression. Subsequently, it is warmed up again—also in the main heat exchanger—to the intermediate temperature. At first glance, this method of operation seems disadvantageous because, as a result of the cooling and reheating, which is unnecessary per se, additional exchange losses and therefore a higher energy consumption are to be expected. However, within the scope of the invention, it was found that, as a result, the heat transfer is improved in the cold part of the main heat exchanger (below the intermediate temperature).

The reason is that, in the cold part of the main heat exchanger, the flows to be warmed up and cooled off have a higher density than in the warm part. The heat exchanger passages, through which they flow, for constructive reasons, as a rule, have the same number and the same cross-sections. In the cold part, the passages are, as it were, operated with an underload of approximately 20%. Because of this fact, the flow conditions are not optimal in the cold part of the main heat exchanger. The invention achieves an improvement here, in that the partial air flow for the cold compression—which has to be subjected to a special treatment anyhow—supplements the flows which are to be cooled as well as the flows which are to be warmed up. It was found that the improvement of the heat transfer as a result of the flow conditions optimized within the scope of the invention in the cold part of the main heat exchanger overcompensates the expected additional exchange losses and, on the whole, results in a process which is particularly favorable with respect to energy. Also, the additional mass flow in the cold part of the main heat exchanger results in a steeper course of the curves of the flows to be warmed up and cooled down in the Q-T diagram and thus in an improvement at the point where these curves comes closest to one another ("theoretical pinch point").

The first partial flow can be at least partially liquified downstream of the cold compression against an evaporating process flow. This heat exchange step can be carried out either in the main heat exchanger or in a separate condenser evaporator This method of operation will be particularly advantageous if the entire oxygen product or a large portion thereof is removed from the rectification as a liquid, is pressurized in liquid form and is finally evaporated against the cold-compressed partial air flow. In this case, just as much air is cold-compressed to ensure that the flow conditions in the cold part of the main heat exchanger are virtually optimal as a result of the reheating of this partial air flow according to the invention.

Preferably, the first partial flow is introduced into the cold end of the main heat exchanger before its warm-up. It is therefore first guided completely through the main heat exchanger and, when being warmed up, flows again through the entire cold part of the main heat exchanger, so that the entire cold part of the main heat exchanger benefits from the improved flow-through.

In this case, the cooling of the first partial flow can be carried out separately from or jointly with other portions of the application air For this purpose, a cooling air flow is cooled in the main heat exchanger, is taken out at the cold end of the main heat exchanger, and, at least partially, is fed again as a first partial flow to the cold end of the main heat exchanger.

In the case of the method according to the invention, it may be advantageous to separate liquid fractions before the rewarming of the first partial flow. For this purpose, after having been taken out of the cold end of the main heat exchanger, the cooling air flow is subjected to a phase separation, during which the first partial flow is formed at least by one part of the vapor phase taken out of the phase separation. Preferably, the entire vapor fraction from the phase separation is led to the cold compression, while the separated liquid is fed into the rectifying column or one of the rectifying columns, for example, into the pressure column of a two-column apparatus Particularly in this case, it is advantageous for the cooling air flow to be expanded before it is subjected to the phase separation. However, also when a phase separation is absent, it may be useful to throttle off the cooling air flow before it is fed as a first partial flow to the cold end of the main heat exchanger.

In principle, the entire flow subjected to the cold compression can be formed by the first partial flow which is withdrawn from the main heat exchanger at the intermediate point. However, in many cases, it is more advantageous to divide the cooling air flow into a first partial flow and into a second partial flow, the first partial flow being introduced into the cold end of the main heat exchanger, and the second partial flow, without temperature changing measures, together with the first partial flow, being fed between its withdrawal at the first intermediate temperature and the cold compression. As a result, cold temperature is additionally introduced into the cold compression flow and is used for the partial or complete compensation or perhaps even overcompensation of the compression heat generated during the cold compression. As a result, an additional parameter is obtained which can be used for optimizing the heat exchange process.

The first partial flow can be fed to the cooling air flow downstream of the cold compression at an intermediate point of the main heat exchanger which corresponds to a second intermediate temperature. Without the compensation of the compression heat described in the previous paragraph, this second intermediate temperature is above the first intermediate temperature. When being mixed with the very cold second partial air flow upstream of the cold compression, the second intermediate temperature may be at or even below the first intermediate temperature.

In addition, it is advantageous for a turbine air flow in the main heat exchanger to be cooled to a third intermediate temperature and to be subsequently expanded in a work-performing manner, in which case at least a portion of the mechanical energy generated during the work-performing expansion is used for driving the cold compression. If the cold temperature required for the process is not generated by an additional expansion machine, it is necessary to couple the expansion machine not only with the cold compressor but, in addition, with a generator or a brake fan.

The invention also relates to a device for the cryogenic separation of air. For example, in one embodiment, the invention includes a device for the cryogenic separation of air having a main heat exchanger which has a warm and a cold end as well as groups of cool-down and warm-up passages, having at least one rectifying column, having an application air line for feeding compressed and purified application air to the main heat exchanger and for feeding at least a portion of the cooled application air into the rectifying column, and having a cold compression line which extends from an intermediate point of the main heat exchanger to a cold compressor, characterized in that the cold compression line is connected upstream of the cold compressor at the intermediate point with a group of warm-up passages of the main heat exchanger. In another embodiment, the invention is further characterized in that the group of warm-up passages of the main heat exchanger, which are connected at the intermediate point with the cold compression line, have a continuous construction from the cold end to the intermediate point and are connected at the cold end with a group of cool-down passages.

BRIEF DESCRIPTION OF THE DRAWINGS

The invention as well as other details of the invention will be explained in the following by means of embodiments schematically illustrated in the drawings.

DETAILED DESCRIPTION OF THE DRAWINGS

Figure 1:
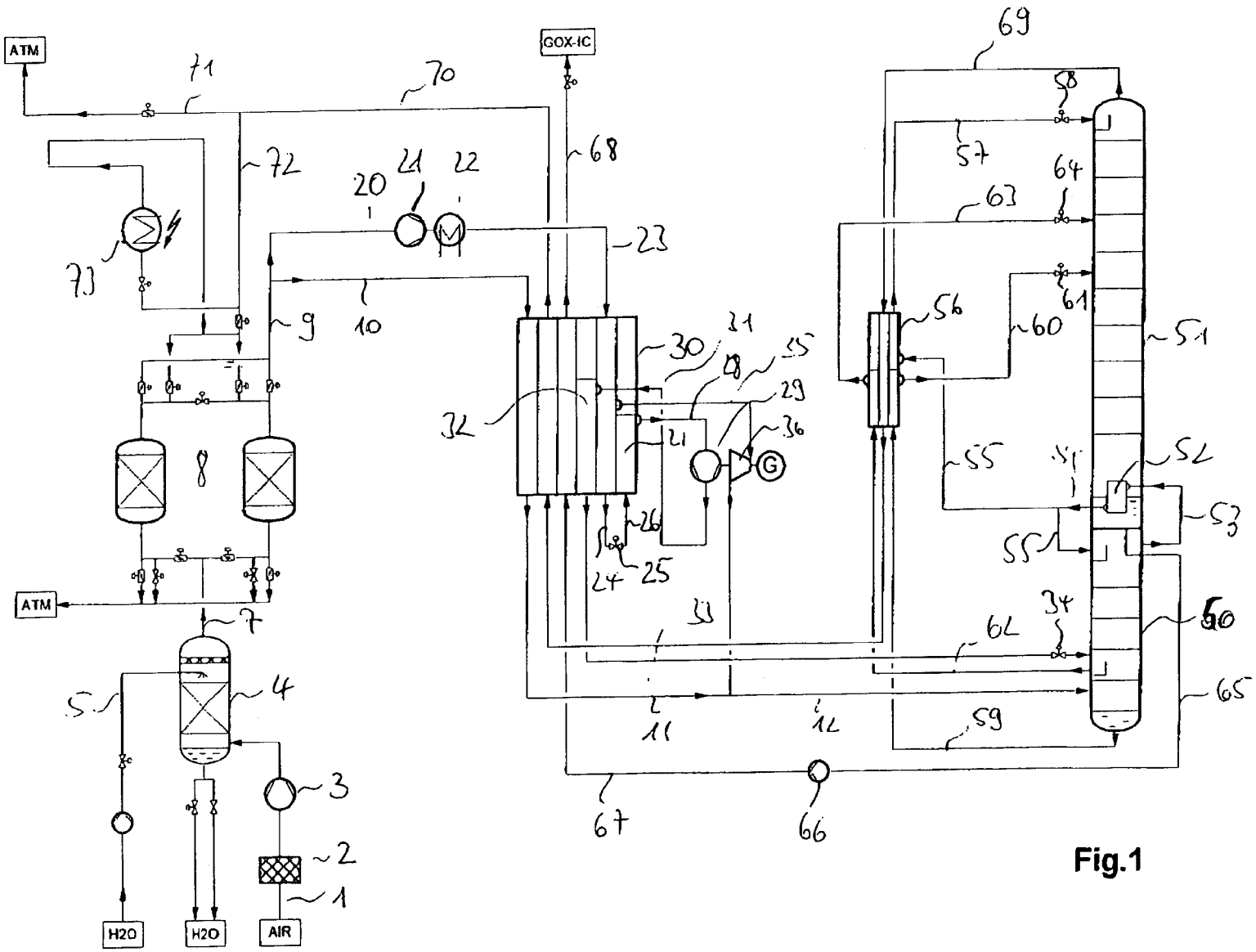
FIG. 1 is a view of a first embodiment of the invention.

Atmospheric air 1 is compressed (3) after flowing through a filter 2 and is introduced into a direct-contact cooler 4. There, it enters into a countercurrent contact with liquid water 5. The water 6, which remained liquid during the direct heat exchange, is withdrawn from the direct contact cooler 4. The cooled air 7 which is charged with water vapor is freed in a purification device 8 of water and carbon dioxide and, as required, of additional impurities. The purification device 8 is preferably formed by at least two switchable containers which are filled by an adsorbent, such as a molecular sieve.

The purified application air flow 9 is divided into a first main air flow 10 and a second main air flow 20. The former flows to the warm end of a main heat exchanger 30; is cooled in the main heat exchanger 30 to approximately the dew point; is withdrawn again at the cold end; and is finally fed by way of the lines 11 and 12 to the sump of the pressure column 50 of a double column.

DETAILED DESCRIPTION OF THE DRAWINGS

The second main air flow 20 is further compressed in an externally driven aftercompressor 21 and, after flowing through an aftercooler 22, is introduced also at the warm end into the main heat exchanger 30 (Line 23). A portion 24 of the second main air flow, the "cooling air flow", remains in the cold end in the main heat exchanger 30 and is—as required, after a slight throttling 25—, introduced as a "first partial flow" 26 again into the main heat exchanger, specifically into the warm-up passages 17. At a first intermediate temperature, the first partial flow is withdrawn by way of the line 28 and is fed to a cold compressor 29. At a second intermediate temperature, which in the example is higher than the first intermediate temperature, the cold-compressed first partial flow 31 is again introduced into the main heat exchanger 30, specifically into the cooling passages 32. After the cooling and at least partial liquefaction in the main heat exchanger, the first partial flow 33 is finally fed by way of the valve 34 into the pressure column 50. The feeding point is situated one or several theoretical or practical trays above the pressure column sump.

Another portion 35 of the second main air flow 23 is withdrawn at a third intermediate temperature, which in the example is between the first and the second intermediate temperature, as a "turbine air flow" and is fed to an expansion machine 36 which is coupled by way of a common shaft with the cold compressor 29 and a generator 37. The air 38, which is expanded in a work-performing manner, is guided together with the first main air flow 11 by way of the line 12 to the sump of the pressure column 50.

In addition to the pressure column 50, the double column has a low-pressure column 51. The two parts are in a heat-exchanging connection by way of a common condenser evaporator 52—the main condenser. Head gas 53 of the pressure column 50 is at least partially condensed in the main condenser 52. The condensate flows to a first part 55 as a return flow back to the pressure column 50; to a second part 55 and is cooled in an undercooling countercurrent device 56; and is charged by way of line 57 and valve 58 to the head of the low-pressure column 51.

Raw oxygen from the lower region of the pressure column 50, in the example, flows to the low-pressure column 51 on along two different routes. A first raw oxygen fraction 59 is undercooled (56) by the sump of the pressure column and is transferred by way of line 60 and throttle valve 61 into the low-pressure column. At the level of the feeding of the liquified first partial air flow 33, a second raw oxygen fraction is discharged in a liquid state from the pressure column 50 and is fed in a similar manner (undercooling 56, line 63 and valve 64) at a slightly higher point into the low-pressure column 51.

The oxygen product is withdrawn by way of line 65 in a liquid state from the sump of the low-pressure column 51; is brought by means of a pump 66 in the liquid condition to the desired product pressure; is guided by way of line 67 to the main heat exchanger 30; is evaporated there and is warmed up approximately to the ambient temperature. The oxygen leaves the system by way of line 68 as an internally compressed product (GOX-IC, gaseous oxygen—internally compressed).

No pure nitrogen is produced in the embodiment The nitrogen-rich head product 69 is warmed up as residual gas in the undercooling countercurrent device 56 and in the main heat exchanger 30. The warm residual gas 70 can be discharged directly by way of line 71 into the atmosphere and/or, by way of line 72—as required, after being heated 73—can be used as regeneration gas for the purification device 8 The humid regeneration gas flows by way of line 74 to the atmosphere.

Deviating from the embodiment, pure nitrogen can also be obtained in the known manner in the low-pressure column. The evaporation of the oxygen 67 pressurized in the liquid state can also be carried out outside the main heat exchanger 30 in a separate product evaporator (auxiliary condenser). The first partial flow flows through the liquefaction space of the product evaporator downstream of the cold compression 29.

Figure 2:
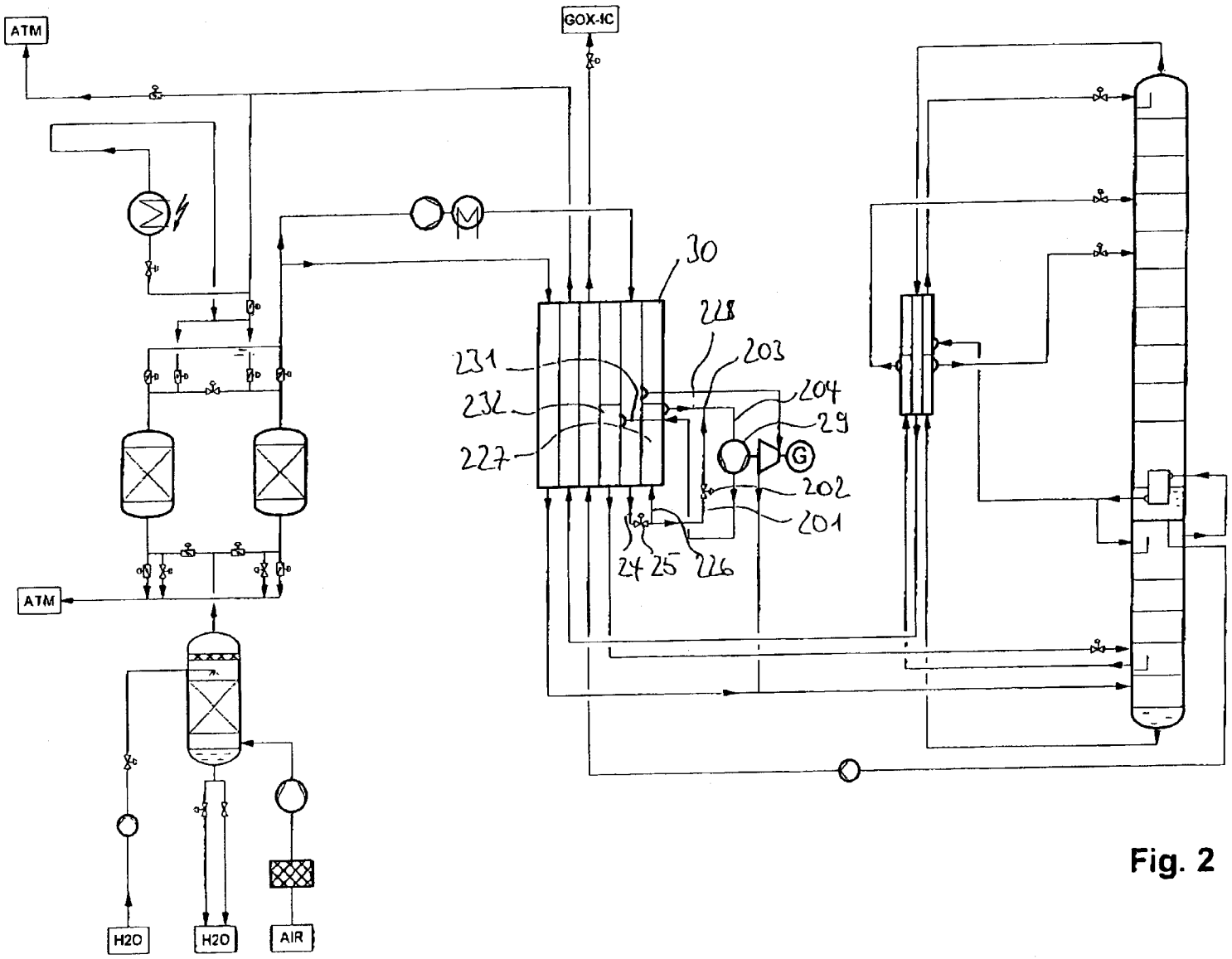
FIG. 2 is a view of a modification of the first embodiment.

The embodiment of FIG. 2 largely corresponds to the method and the device of FIG. 1. In the following, only the deviating aspects will be described in detail.

In FIG. 2, the cooling air flow 24 is divided downstream of its withdrawal form the cold end of the main heat exchanger 30 or from the optional valve 25 into two flows, specifically the "first partial flow" 226-227-228, which is guided analogous to the method of FIG. 1 to the cold compressor 29, and a "second partial flow" 201 which—controlled by valve 202—is guided past the main heat exchanger 30 and particularly past the warm-up passages 227 and, at reference number 203, is admixed to the first partial flow 228 warmed up to the first intermediate temperature. At a correspondingly lower temperature, the mixture flows to the inlet of the cold compressor 29. Therefore, also the cold-compressed air 231 has a lower temperature than in FIG. 1. In the concrete example of FIG. 2, the second intermediate temperature is even lower than the first intermediate temperature. The cooling and liquefaction passages 232 for the first partial flow downstream of the cold compression therefore have a correspondingly shorter construction.

Also concerning FIG. 3, only the differences with respect to FIG. 1 will be discussed in detail in the following. After the partial liquefaction in the main heat exchanger 30 and the throttling 25, the cooling air flow 24 is introduced here into a separator 301 for the purpose of a phase separation. Analogous to the flow 33 of FIG. 1, the liquid phase is fed by way of line 333 and valve 334 into the pressure column 50. The vapor 326 from the separator 301 forms the "first partial flow" which, as in FIG. 1, is guided to the cold compression 29. However, downstream of the cold compression 29, the cold-compressed first partial flow 331 is not introduced into separate cooling passages but is mixed with the second main air flow. The cold-compressed air quantity will therefore be guided in a loop 24-25-301-326-29-331. Thus, the heat transfer in the cold part of the main heat exchanger can have a particularly advantageous design.

Figure 3:
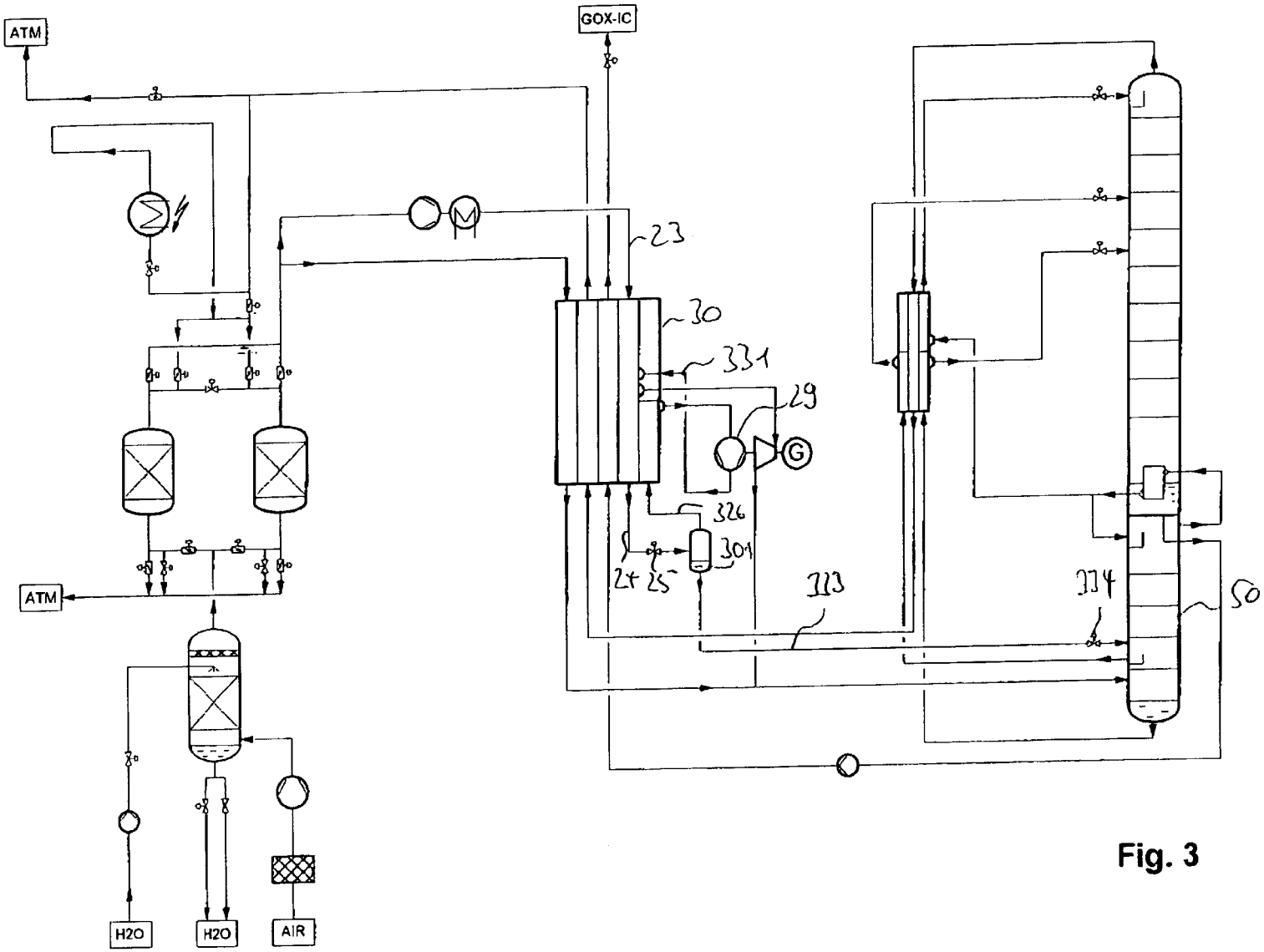
FIG. 3 is a view of a second embodiment of the invention.
Figure 4:
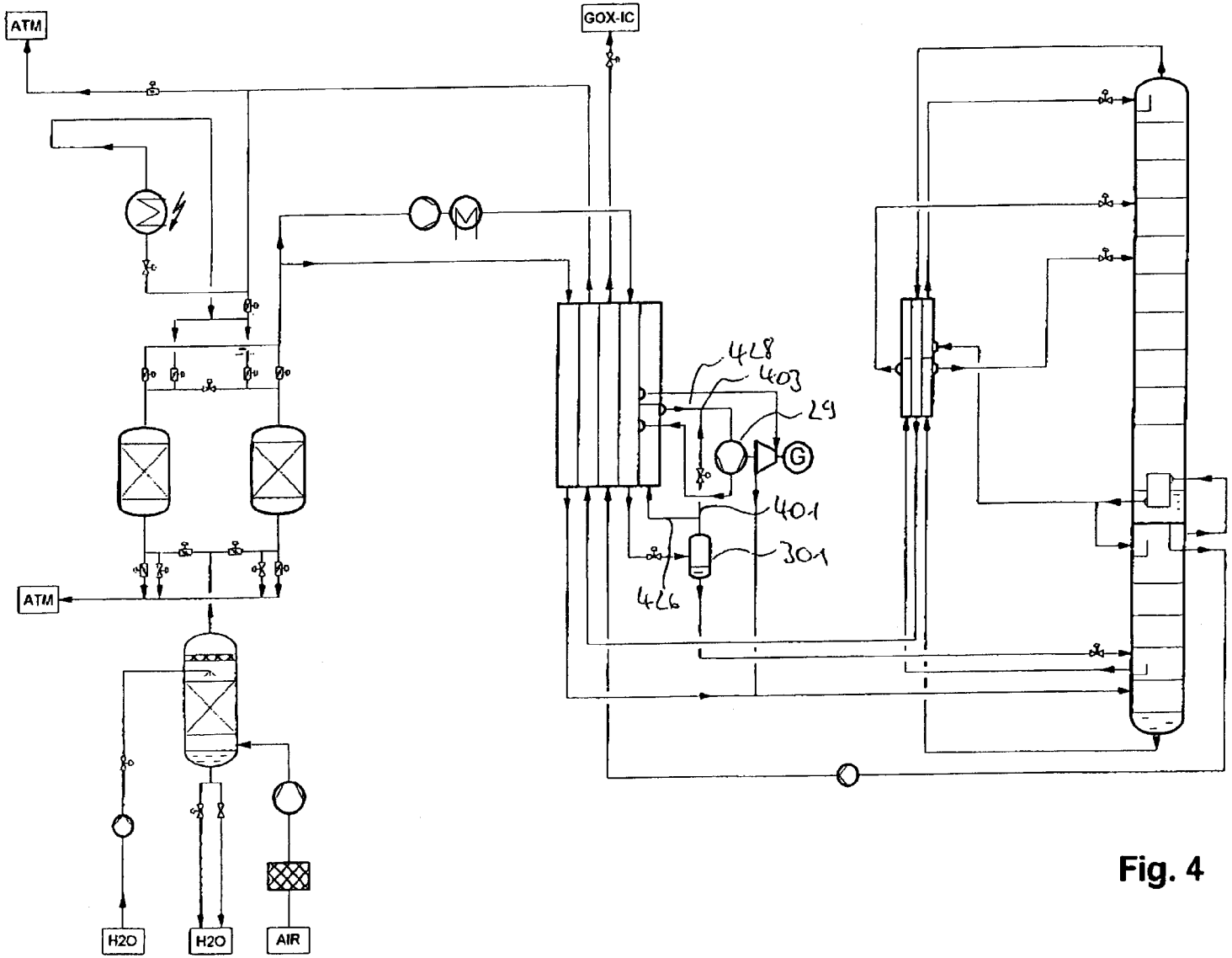
FIG. 4 is a view of a modification of the second embodiment.

FIG. 4 differs from FIG. 3 in the same manner as FIG. 2 differs from FIG. 1, specifically by an additional "second partial air flow" 401. Here, this second partial air flow is formed of that portion 401 of the vapor from the separator 301 which is not guided by way of a line 426 as a "first partial flow" to the cold end of the main heat exchanger 30. As in FIG. 2, the admixing 403 of the cold second partial flow 401 to the first partial flow 428 warmed up to the first intermediate temperature is used for the compensation or overcompensation of the compression heat which is generated during the cold compression.

What is claimed is:

1. Method for the cryogenic separation of air, in which compressed and purified application air is cooled in a main heat exchanger and is supplied at least in part to a rectifying column, a first partial flow of the application air being fed to the main heat exchanger, being at least partially withdrawn at a first intermediate temperature from the main heat exchanger, and being guided to a cold compression, wherein the first partial flow is warmed up upstream its withdrawal at the first intermediate temperature in the main heat exchanger.

2. Method according to claim 1, wherein the first partial flow is introduced before its warm-up into the cold end of the main heat exchanger.

3. Method according to claim 2, wherein a cooling air flow is cooled in the main heat exchanger, is withdrawn at the cold end of the main heat exchanger and is fed at least partially as a first partial flow back to the cold end of the main heat exchanger.

4. Method according to claim 3, wherein, after its withdrawal from the cold end of the main heat exchanger, the cooling air flow is subjected to a phase separation, the first partial flow being formed at least by a portion of the vapor phase withdrawn from the phase separation.

5. Method according to claim 3, wherein the cooling air flow is expanded before it is subjected to the phase separation or is fed as a first partial flow to the cold end of the main heat exchanger.

6. Method according to claim 3, wherein the cooling air flow is divided into the first partial flow and into a second partial flow, the first partial flow being introduced into the cold end of the main heat exchanger, and the second partial flow without temperature-changing measures, being supplied together with the first partial flow between its withdrawal at the first intermediate temperature and the cold compression.

7. Method according to claim 3, wherein the first partial flow downstream of the cold compression is fed to the cooling air flow at an intermediate point of the main heat exchanger which corresponds to a second intermediate temperature.

8. Method according to claim 3, wherein a turbine air flow in the main heat exchanger is cooled to a third intermediate temperature and is subsequently expanded in a work-performing manner, at least a portion of the mechanical energy generated during the work-performing expansion being used for driving the cold compression.

9. Device for the cryogenic separation of air comprising:

a main heat exchanger which has a warm and a cold end as well as groups of cool-down and warm-up passages, at least one rectifying column an application air line for feeding compressed and purified application air to the main heat exchanger and for feeding at least a portion of the cooled application air into the rectifying column, and a cold compression line which extends from an intermediate point of the main heat exchanger to a cold compressor, wherein the cold compression line is connected upstream of the cold compressor at the intermediate point with a group of warm-up passages of the main heat exchanger.

10. Device according to claim 9, wherein the group of warm-up passages of the main heat exchanger, which are connected at the intermediate point with the cold compression line, have a continuous construction from the cold end to the intermediate point and are connected at the cold end with a group of cool-down passages.

11. Method according to claim 4, wherein the cooling air flow is expanded before it is subjected to the phase separation or is fed as a first partial flow to the cold end of the main heat exchanger.

12. Method according to claim 4, wherein the cooling air flow is divided into the first partial flow and into a second partial flow, the first partial flow being introduced into the cold end of the main heat exchanger, and the second partial flow, without temperature-changing measures, being supplied together with the first partial flow between its withdrawal at the first intermediate temperature and the cold compression.

13. Method according to claim 5, wherein the cooling air flow is divided into the first partial flow and into a second partial flow, the first partial flow being introduced into the cold end of the main heat exchanger, and the second partial flow, without temperature-changing measures, being supplied together with the first partial flow between its withdrawal at the first intermediate temperature and the cold compression.

14. Method according to claim 4, wherein the first partial flow downstream of the cold compression is fed to the cooling air flow at an intermediate point of the main heat exchanger, which corresponds to a second intermediate temperature.

15. Method according to claim 5, wherein the first partial flow downstream of the cold compression is fed to the cooling air flow at an intermediate point of the main heat exchanger, which corresponds to a second intermediate temperature.

16. Method according to claim 6, wherein the first partial flow downstream of the cold compression is fed to the cooling air flow at an intermediate point of the main heat exchanger, which corresponds to a second intermediate temperature.

17. Method according to claim 4, wherein a turbine air flow in the main heat exchanger is cooled to a third intermediate temperature and is subsequently expanded in a work-performing manner, at least a portion of the mechanical energy generated during the work-performing expansion being used for driving the cold compression.

18. Method according to claim 5, wherein a turbine air flow in the main heat exchanger is cooled to a third intermediate temperature and is subsequently expanded in a work-performing manner, at least a portion of the mechanical energy generated during the work-performing expansion being used for driving the cold compression.

19. Method according to claim 6, wherein a turbine air flow in the main heat exchanger is cooled to a third intermediate temperature and is subsequently expanded in a work-performing manner, at least a portion of the mechanical energy generated during the work-performing expansion being used for driving the cold compression.

20. Method according to claim 7, wherein a turbine air flow in the main heat exchanger is cooled to a third intermediate temperature and is subsequently expanded in a work-performing manner, at least a portion of the mechanical energy generated during the work-performing expansion being used for driving the cold compression.

* * * * *